US006781307B2

(12) United States Patent
Lee

(10) Patent No.: US 6,781,307 B2
(45) Date of Patent: Aug. 24, 2004

(54) ELECTROLUMINESCENT DEVICE AND METHOD FOR MANUFACTURING THE SAME

(75) Inventor: Jong Won Lee, Daejon-Kwangyokshi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 150 days.

(21) Appl. No.: 09/893,989

(22) Filed: Jun. 29, 2001

(65) Prior Publication Data

US 2002/0079835 A1 Jun. 27, 2002

(30) Foreign Application Priority Data

Dec. 27, 2000 (KR) ..... 2000-83098

(51) Int. Cl.[7] ..... H05B 33/12
(52) U.S. Cl. ..... 313/506; 313/509
(58) Field of Search ..... 313/498, 499, 313/500, 501, 502, 503, 504, 506, 509; 428/690, 917

(56) References Cited

U.S. PATENT DOCUMENTS 4,774,435 A * 9/1988 Levinson ..... 313/509
5,936,347 A * 8/1999 Isaka et al. ..... 313/509
6,215,244 B1 * 4/2001 Kuribayashi et al. ..... 313/505
6,396,208 B1 * 5/2002 Oda et al. ..... 313/504

FOREIGN PATENT DOCUMENTS

JP 2001135477 A * 5/2001 ..... H05B/33/02

* cited by examiner

*Primary Examiner*—Nimeshkumar D. Patel
*Assistant Examiner*—Karabi Guharay
(74) *Attorney, Agent, or Firm*—Morgan, Lewis & Bockius LLP

(57) ABSTRACT

An electroluminescent device and a method for manufacturing the same are provided to achieve a highly luminous electroluminescent device that can be used as a backlight for an LCD monitor. The electroluminescent device includes a substrate, a lower electrode layer having a surface of a plurality of convex shapes formed on the substrate, an insulating layer, a light-emitting layer, and an upper electrode layer sequentially formed on the lower electrode layer, and a passivation layer formed on the upper electrode layer. The method for manufacturing an electroluminescent device includes forming a lower electrode layer having a surface of a plurality of convex shapes on a substrate, sequentially forming an insulating layer, a light-emitting layer, and an upper electrode layer over the lower electrode layer to have substantially corresponding surface shapes as the lower electrode layer, and forming a passivation layer on the upper electrode layer.

15 Claims, 5 Drawing Sheets

ELECTROLUMINESCENT DEVICE AND METHOD FOR MANUFACTURING THE SAME

This application claims the benefit of Korean Application No. P 2000-83098, filed in Korea on Dec. 27, 2000, which is hereby incorporated by reference.

BACKGROUND OF THE INVENTION

1. Field of the Invention

The present invention relates to a display device, and more particularly, to an electroluminescent device and a method for manufacturing the same.

2. Discussion of the Related Art

Ultra thin sized flat panel displays having a display screen with a thickness of several centimeters, especially liquid crystal display (LCD) devices, are widely used for monitors in notebook computers, spacecraft, aircraft, etc.

LCD panels are in general non-luminous and require a backlight at the rear of the liquid crystal panel as a light source. The conventional, backlight is not satisfactory because of its large weight, power consumption, and thickness. In this respect, it is desirable to replace the conventional backlight with a thinner, lighter, less-power consuming alternative. Currently, thin and light electroluminescent devices are under research and development.

Electroluminescent devices can be divided into two types: a light-emitting diode (LED) and an electroluminescent diode (ELD), depending on the operational principles. The light emission of LEDs is based on a radiant transition due to electron-hole recombination near a P-N junction. Recently, a rapid development of an LED based on an organic material is in progress.

On the other hand, the light emission of ELDs is based on luminescence that takes place when high energy electrons generated in a light-emitting layer excite a phosphor upon impact, Electrons within the light-emitting layer acquire energy from a high electric field and turn into hot electrons. The hot electrons then excite an activator to generate light.

ELDs are manufactured by thick-film printing of a mixture of resin and light-emitting powder or by thin film printing. ELDs are also divided into two types: the AC type and the DC type, depending on the driving modes.

An electroluminescent device of the related art will be described with reference to FIG. 1. FIG. 1 is a schematic perspective view of a related art electroluminescent device. As shown in FIG. 1, the related art electroluminescent device includes a substrate 11 and a transparent electrode layer 13 on the substrate 11. The transparent electrode layer 13 is formed in a predetermined pattern, such as in a stripe pattern. The transparent electrode 13 is formed of indium tin oxide (ITO), for example. A lower insulating layer 15 of $SiO_X$, $SiN_X$, or $BaTiO_3$ is formed on the transparent electrode layer 13, and a light-emitting layer 17 of a ZnS based light-emitting material is formed on the lower insulating layer 15. The related art device further includes an upper insulating layer 19 made of $SiO_X$, $SiN_X$, or $Al_2O_3$ on the light-emitting layer 17. It further includes a metal electrode layer 21 made of a metal, such as Al, on the upper insulating layer 19, and a surface passivation layer 23 on the metal electrode layer 21.

In this related art electroluminescent device, when an AC voltage is applied between the transparent electrode layer 13 and the metal electrode layer 21, a high electric field in the order of $10^6$ V/cm is built within the light-emitting layer 17.

Electrons generated in the interface between the upper insulating layer 19 and the light-emitting layer 17 tunnel into the light-emitting layer 17.

The tunneling electrons are accelerated by the high electric field in the light-emitting layer 17. The accelerated electrons collide with activators (Cu and/or Mn) within the light-emitting layer 17 to excite electrons in the ground state to excited states. When electrons at a higher energy level transit to the vacant sites in a lower energy level state created by the excitation—e.g., when the excited electrons transit to the ground state (or to other lower energy level states), light having a wavelength corresponding to the energy difference is emitted. The color of the emitted light thus depends on the energy difference.

A method for manufacturing the related art electroluminescent device will now be described in more detail. The transparent electrode layer 13 is formed on the glass substrate 11. Specifically, a thin ITO film having a high conductivity end a good transparent physical characteristic is deposited on the substrate 11. The thin ITO film is then patterned by photolithography into a stripe shape to form transparent electrodes, which are collectively referred to as "transparent electrode layer 13."

A $BaTiO_3$ based lower insulating layer 15 is formed on the transparent electrode layer 13 by RF reactive sputtering. The light-emitting layer 17 is then formed on the lower insulating layer 15. The light-emitting layer 17 may be formed via electron-beam deposition by cold pressing a powder of a Cu or Mn doped ZnS material and by generating small grains. Alternatively, the light-emitting layer 17 nay be formed by sputtering using a target.

The upper insulating layer 19 of $SiO_X$, $SiN_X$, or $Al_2O_3$ is formed on the light-emitting layer 17 by sputtering or chemical vapor deposition (CVD). The metal electrode layer 21 is formed on the upper insulating layer 19. Specifically, a thin Al or Ag film is formed on the upper insulating layer 19 by thermal deposition and is patterned into stripe-shaped metal electrodes that extend perpendicularly to the transparent electrodes of the transparent electrode layer 13 underneath. Finally, the surface passivation layer 23 is formed on the metal electrode layer 21. This completes the manufacture of the related art electroluminescent device.

However, the related art electroluminescent device have several drawbacks. As briefly explained above because a thin film transistor (TFT) liquid crystal display (LCD) panel (TFT-LCD panel) for notebook computers and monitors has no self-luminous function, a light-emitting device such as a backlight is required. Since the conventional backlight is constructed by combining a light-guiding plate, a light-diffusion plate, and a prism with a cold cathode fluorescent lamp, the manufacturing cost is high, and the manufacturing process is undesirably complicated. Moreover, the large thickness of the backlights increases the thickness of the resultant monitor devices, which is undesirable. To substitute for such a conventional backlight, the related, art electroluminescent device has been proposed. Although the manufacturing cost and thickness of the related art electroluminescent device have been somewhat reduced recently, it is still expensive. Moreover, the related art electroluminescent device still has an insufficient luminance to be used as a light source for LCDs.

SUMMARY OF THE INVENTION

Accordingly, the present invention is directed to an electroluminescent device and a method for manufacturing the same that substantially obviate one or more of the problems due to limitations and disadvantages of the related art.

An object of the present invention is to provide an electroluminescent device and a method for manufacturing the same, in which a sufficiently high luminance can be obtained so that the device can be used as a backlight for LCD panels.

Additional features and advantages of the invention will be set forth in the description which follows, and in part will be apparent from the description, or may be learned by practice of the invention. The objectives and other advantages of the invention will be realized and attained by the scheme particularly pointed, out in the written description and claims hereof as well as the appended drawings.

To achieve these and other advantages and in accordance with the purpose of the present invention, as embodied and broadly described, the electroluminescent device according to a first aspect includes a lower electrode layer having a surface of a plurality of convex shapes, formed on the substrate, an insulating layer, a light-emitting layer, and an upper electrode layer sequentially formed on the lower electrode layer, and a passivation layer formed on the upper electrode layer.

In another aspect, the prevent invention provides a method for manufacturing an electroluminescent device, the method including forming a lower electrode layer having a surface of a plurality of convex shapes on a substrate, sequentially forming an insulating layers a light-emitting layer, and all upper electrode layer over the lower electrode layer to have the same shapes as the lower electrode layer, and forming a passivation layer on the upper electrode layer.

In another aspect, the prevent invention provides an electroluminescent device including a substrate; a lower electrode layer over the substrate, having a plurality of convex shapes in its surface; an insulating layer over the lower electrode layer; a light-emitting layer over the insulating layer; an upper electrode layer over the light-emitting layer; and a passivation layer over the upper electrode layer, wherein the insulating layer, the light-emitting layer, and the upper electrode layer are formed in succession.

In another aspect, the present invention provides a method for manufacturing an electroluminescent device, the method including forming, over a substrate, a lower electrode layer having a plurality of convex shapes in its surface; forming, over the lower electrode layer, an insulating layer, a light-emitting layer, and an upper electrode layer in succession so that the insulating layer, the light-emitting layer, and the upper electrode layer have substantially the same surface profile as the lower electrode layer; and forming a passivation layer over the upper electrode layer.

In a further aspect, the present invention provides an electroluminescent device including a substrate; a lower electrode layer over the substrate, having an uneven surface profile; an insulating layer over the lower electrode layer, having an uneven surface profile substantially corresponding to the uneven surface profile of the lower electrode layer; a light-emitting layer over the insulating layer, having an uneven surface profile substantially corresponding to the uneven surface profile of the insulating layer; and an upper electrode layer over the light-emitting layer, having an uneven surface profile substantially corresponding to the uneven surface profile of the light-emitting layer.

It is to be understood that both the foregoing general description and die following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated, in the accompanying drawings.

First Embodiment

Figure 2:
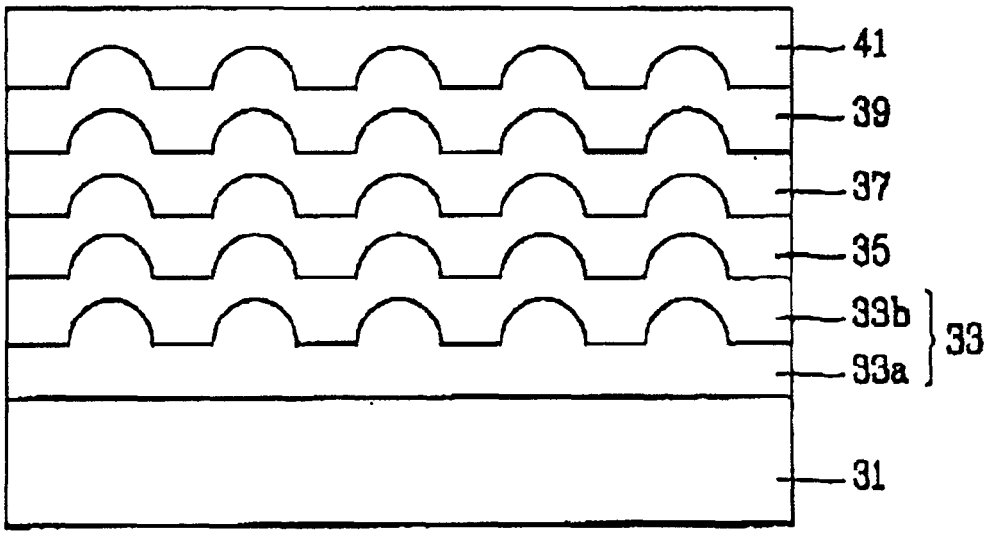
FIG. 2 is a sectional view of an electroluminescent device according to a first embodiment of the present invention.

FIG. 2 is a sectional view of air electroluminescent device according to a first embodiment of the present invention. FIGS. 3A to 3D are sectional views illustrating process steps for manufacturing the electroluminescent device according to the first embodiment of the present invention.

As shown in FIG. 2, the electroluminescent device according to the present invention includes a substrate 31, and a lower electrode layer 33 formed on the substrate 31. The lower electrode layer 33 has a surface profile of a plurality of convex shapes. An insulating layer 35 is formed on the lower electrode layer 33, and a light-emitting layer 37 is formed on the insulating layer 35. The electroluminescent device of FIG. 2 further includes an upper electrode layer 39 formed on the light-emitting layer 37 and a passivation layer 41, formed on the upper electrode layer 39.

Figure 1:
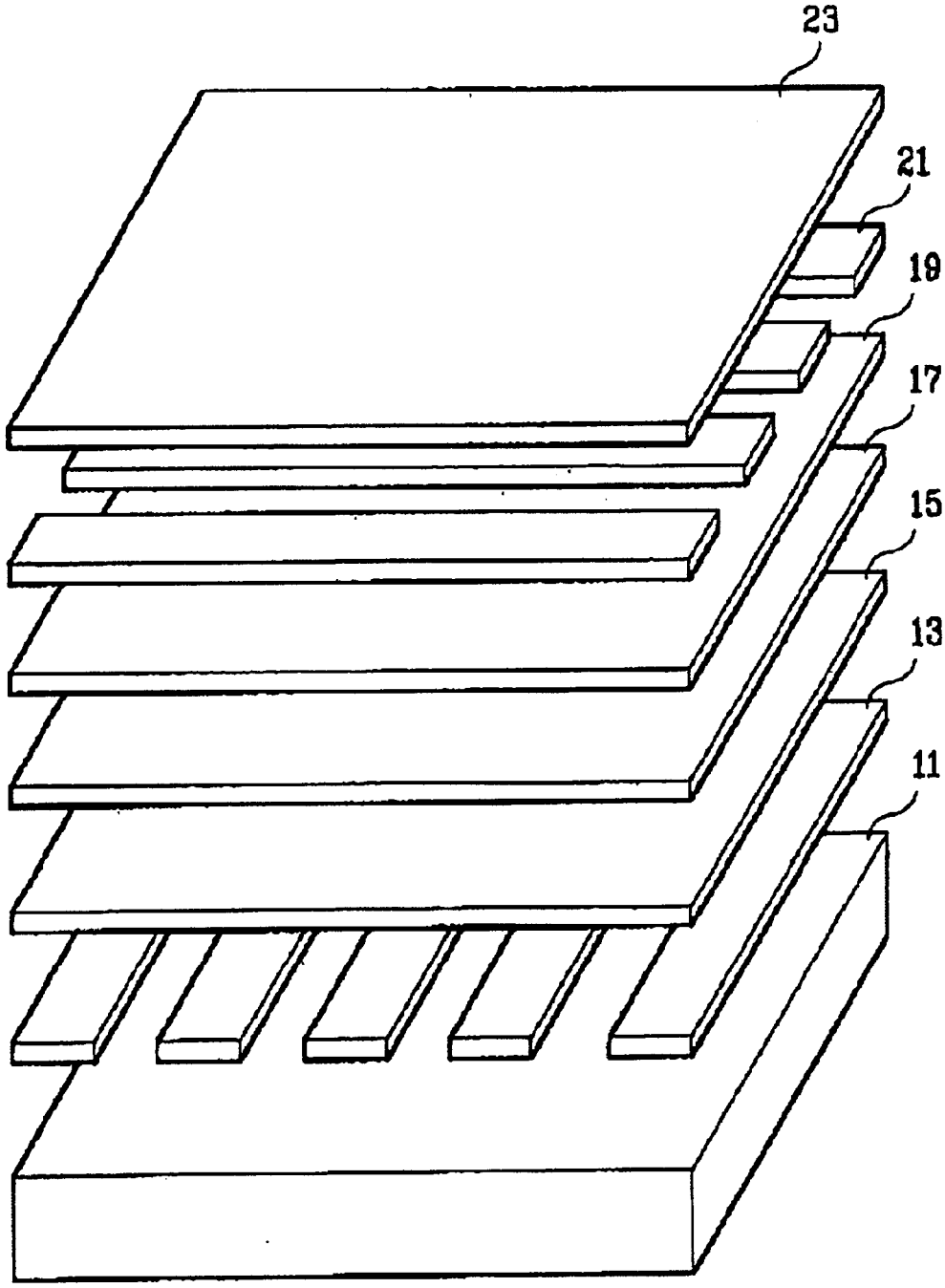
FIG. 1 Related Art
FIG. 1 is a perspective view of a related art electroluminescent device.

If desired, the lower electrode layer 33 and/or upper electrode layer 39 may be patterned into a plurality of stripes crossing each other in a manner similar to the related art device of FIG. 1. In such a case, FIGS. 2 and 3A–3D illustrate a portion of the cross-sections where the stripes of the upper electrode cross the stripes of the lower electrode. (The same is true for FIGS. 4 and 5A–5D below.)

The lower electrode layer 33 has a layered structure made of either a pair of a polysilicon layer 33*a* and a metal layer 33*b* or a pair of a tungsten layer 33*a* and a metal, layer 33*b*. If the lower electrode layer 33 is to have a layered, structure made of the polysilicon layer 33*a* and the metal layer 33*b*, the polysilicon layer 33*a* is preferably formed by low pressure chemical vapor deposition (LPCVD), and the metal layer 33*b* is preferably formed by thermal deposition. If the lower electrode layer 33 is to have a layered structure made of the tungsten layer 33*a* and the metal layer 33*b*, the tungsten layer 33*a* is preferably formed by chemical vapor deposition (CVD) to create the uneven surface profile. Here, the insulating layer 35 is formed of a $BaTiO_3$ based material having a high dielectric constant, and the upper electrode layer 39 is formed of a transparent conductive material such as indium tin oxide (ITO).

In this example, because the surface of the lower electrode layer 33 has a plurality of convex shapes, the insulating layer 35, the light-emitting layer 37, and the upper electrode layer 39, which ale formed over the lower electrode layer 33 in succession, also have the substantially the same surface profile of a plurality of convex shapes. The uneven surface profile of the lower electrode layer 33 thus helps increase the luminance of the resultant device by increasing the surface areas of the light-emitting layer 37.

Figure 3A:
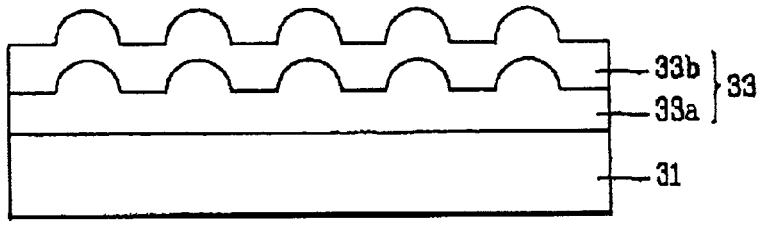
FIGS. 3A to 3D are sectional views illustrating process steps for manufacturing the electroluminescent device according to the first embodiment of the present invention.

A method for manufacturing the electroluminescent device according to the first embodiment of the present invention will now be described with reference to FIGS. 3A to 3D. As shown in FIG. 3A, the lower electrode layer 33 is formed on the substrate 31 (e.g., glass substrate). Specifically, a polysilicon layer 33*a*, for example, is growl Oil the substrate 31 by LPCVD at a temperature between about 560° C. and about 610° C. Then, a metal layer 33*b* having an excellent light reflecting characteristic, such as Al or Ag, is formed on the polysilicon layer 33*a* by thermal deposition.

When, the polysilicon layer 33*a* is grown by LPCVD at a temperature between about 560° C. and about 610° C., the resultant polysilicon layer 33*a* exhibits a surface profile having a plurality of convex shapes each of which resembles a hemispheric shape. The metal layer 33*b* is then formed along the uneven surface of the polysilicon layer 33*a*. Accordingly, the resultant metal layer 33*b* exhibits substantially the same surface profile as the polysilicon layer 33*a*.

Instead of the polysilicon, layer 33*a*, a tungsten layer may be grown by CVD as the layer 33*a*. In this case, the tungsten layer 33*a* exhibits all uneven surface profile having a plurality of convex shapes each of which has a shape similar to a hemispheric shape although the resemblance to the hemispheric shape is in general not so strong as compared to the case of polysilicon layer 33*a*.

Figure 3B:
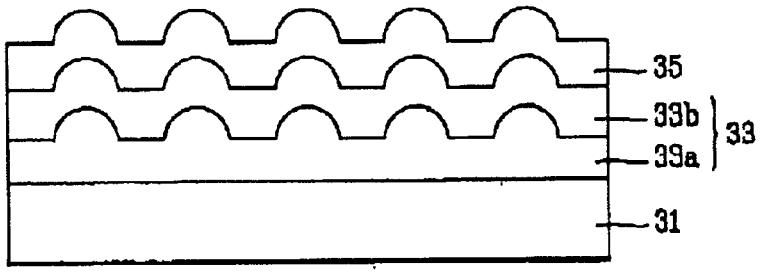

After the surface of the lower electrode layer 33 is formed to have a plurality of convex shapes, as shown in FIG. 3B, the insulating layer 35 is formed on the lower electrode layer 33. The insulating layer 35 is formed of, for example, a $BaTiO_3$ based material by sputtering or CVD. The surface of the insulating layer 35 also exhibits a plurality of convex shapes because of the uneven surface profile of the metal layer 33*b* thereunder.

Figure 3C:
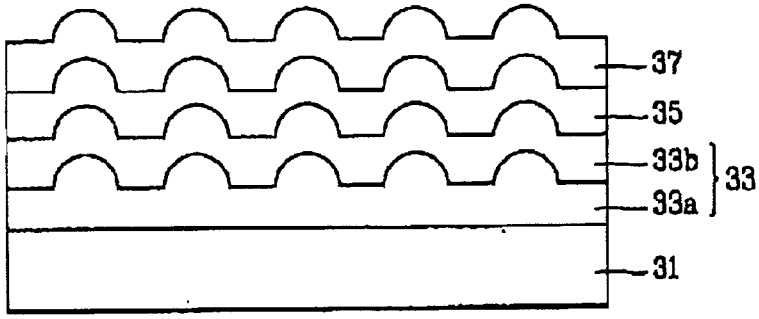

As shown in FIG. 3C, the light-emitting layer 37 is then formed on the insulating layer 35. The light-emitting layer 37 is formed of, for example, a ZnS based material by electron beam deposition or sputtering. Again, because the surface of the resultant insulating layer 35 has an uneven surface profile having a plurality of convex shapes, the surface of the resultant light-emitting layer 37 also exhibits an uneven surface profile having a plurality of convex shapes.

Figure 3D:
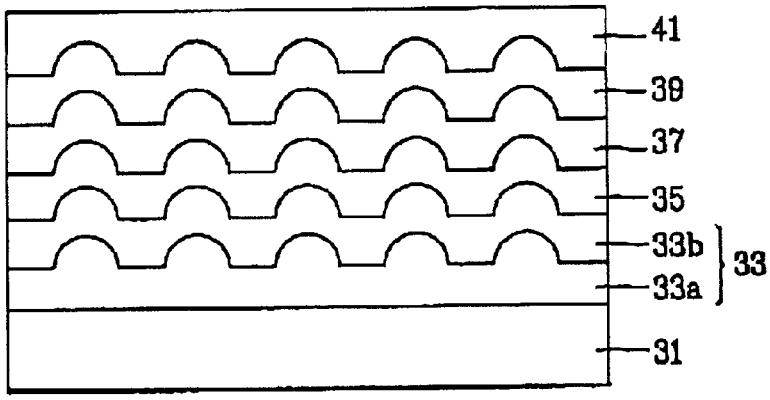

Referring to FIG. 3D, the upper electrode layer 39 is formed on the light-emitting layer 37 by sputtering. The upper electrode layer 39 is formed of a transparent material, e.g. an indium tin oxide (ITO) material, having a high conductivity. The upper electrode layer 39 is then patterned by photolithography. Thereafter, the passivation layer 41 is formed on the patterned upper electrode layer 39 to protect the surface thereof. This completes the manufacture of the electroluminescent device according to the first embodiment of the present invention.

In the electroluminescent device of the first embodiment, a metal having an excellent reflecting characteristic, such as Al or Ag, is used in the lower electrode layer, and a polysilicon or tungsten layer having a significantly uneven surface profile (e.g., having a plurality of convex shapes) is formed under the metal layer in order to increase the surface area of the metal layer thereabove. This construction helps increase upward convergence effects upon light, and thus improves the luminance of the device. Further, as shown in FIG. 2, because no upper insulating layer is formed on the light-emitting layer 37, a voltage drop due to the upper insulating layer is eliminated, thereby lowering the driving voltage, which is desirable.

Second Embodiment

Figure 4:
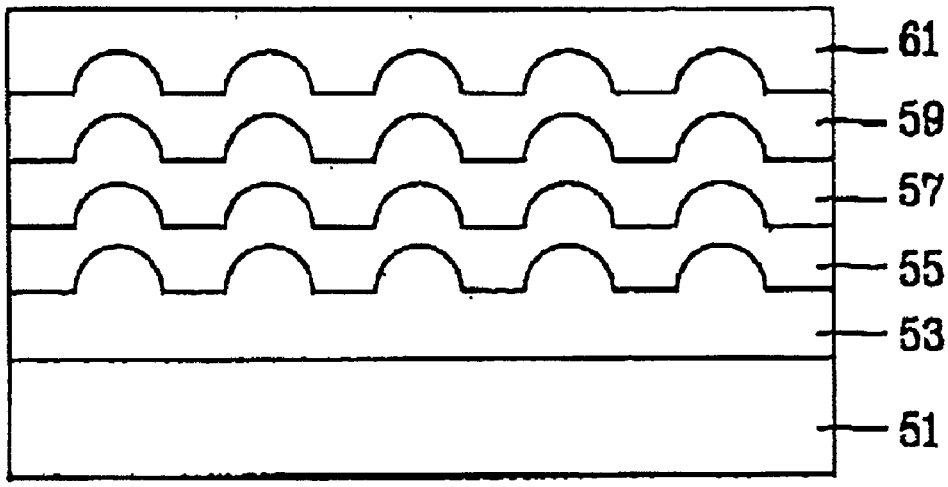
FIG. 4 is a sectional view of an electroluminescent device according to a second embodiment of the present invention.

FIG. 4 is a sectional view of an electroluminescent device according to a second embodiment of the present invention. FIGS. 5A to 5D are sectional views illustrating process steps for manufacturing the electroluminescent device according to the second embodiment of the present invention.

As described above, in the first embodiment of the present invention, the lower electrode layer is formed of a layered structure of either a polysilicon layer and a metal layer, or a tungsten layer and a metal layer. In contrast, in the second embodiment of the present invention, the lower electrode layer is formed essentially of a single layer of metal only.

As shown in FIG. 4, the electroluminescent device according to the second embodiment of the present invention includes a substrate 51 and a lower electrode layer 53 formed on the substrate 51. The lower electrode layer 53 has an uneven surface profile having a plurality of convex shapes. The device of the second embodiment further includes an insulating layer 55, a light-emitting layer 57, an upper electrode layer 59, and a passivation layer 61. The insulating layer 55, the light-emitting layer 57, the upper electrode layer 59, and the passivation layer 61 are formed over the lower electrode layer 53 in succession.

A metal having all excellent reflecting characteristic, such as Al or Ag, is used as the lower electrode layer 53. If the lower electrode layer 53 is to be formed by thermal deposition or like process, its surface does not normally exhibit an uneven profile. In this example, the surface of the lower electrode layer 53 is engraved by wet etching, dry etching, or both wet and dry etching processes in order to form an uneven surface having a plurality of convex shapes.

Figure 5A:
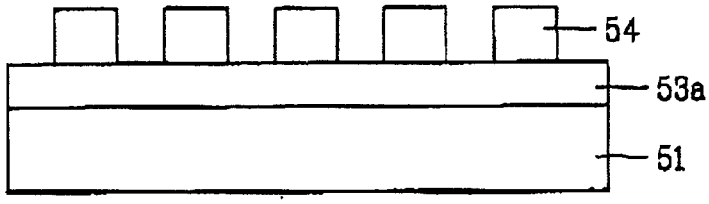
FIGS. 5A to 5D are sectional views illustrating process steps for manufacturing the electroluminescent device according to the second embodiment of the present invention.

A method for manufacturing the electroluminescent device according to the second embodiment of the present invention will now be described with reference to FIGS. 5A to 5D. As shown in FIG. 5A, the lower electrode layer 53 is formed on the substrate 51. (e.g., glass substrate). Specifically, after a metal layer 53*a* having an excellent light reflecting characteristic, such as Al or Ag, is formed on the substrate 51 by thermal deposition, a photoresist pattern 54 is formed on the metal layer 53*a*.

Figure 5B:
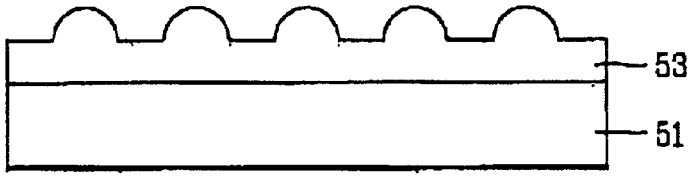

The photoresist pattern 54 serves as a mask when the lower metal layer 53 is etched for the purpose of forming an uneven surface profile having a plurality of convex shapes. A dry etching process find a wet etching process are successively performed using the photoresist pattern 54 as a mask. As a result, as shown in FIG. 5B, the metal layer 53*a* turns into the lower electrode layer 53 raving a plurality of convex shapes in its surface.

Figure 5C:
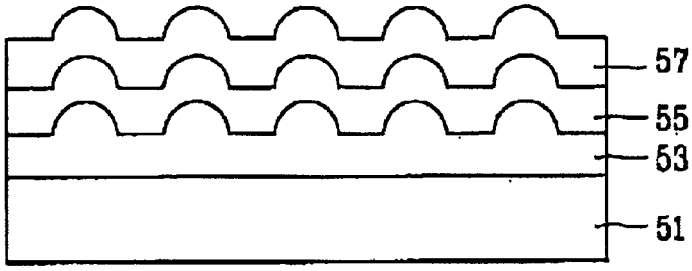

Subsequently, as shown in FIG. 5C, an insulating material having a high dielectric constant, such as $BaTiO_3$ based material, is deposited over the lower electrode layer 53 by sputtering to form the insulating layer 55. A ZnS based light-emitting maternal is deposited on the insulating layer 55 by electron beam deposition or sputtering to form the light-emitting layer 57.

Figure 5D:
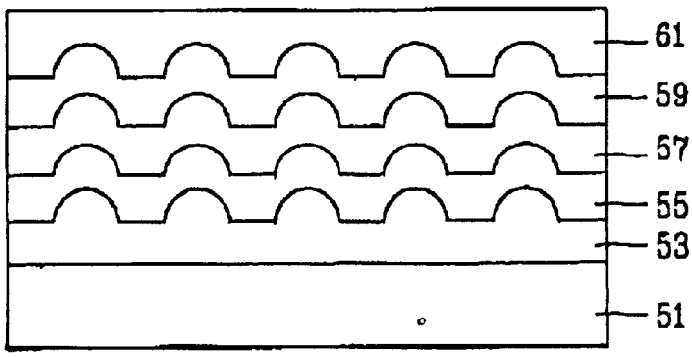

Referring to FIG. 5D, a transparent conductive material, such as ITO, is deposited on the light-emitting layer 57. The transparent conductive material is then patterned by photolithography to form the upper electrode layer 59. The passivation layer 61 is then formed on the upper electrode layer 59. This completes the manufacture of the electroluminescent device according to the second embodiment of the present invention.

In the electroluminescent device according to the second embodiment of the present invention, when an AC voltage of a sufficient amplitude is applied between the lower electrode layer 53 and the upper electrode layer 59, a high electric field in the order of $10^6$ V/cm is built within the light-emitting layer 57. Electrons generated in the interface between the insulating layer 55 and the light-emitting layer 57 tunnel into the light-emitting layer 57. The tunneling electrons are accelerated by the high electric field within the light-emitting layer 57. The accelerated, electrons collide with activators in the light-emitting layer 57 to excite electrons in the ground state to some excited states. When electrons at a higher energy level transit to the vacant sites in a lower energy level state created by the excitation—e.g., when the excited electrons transit to the ground state (or to other lower energy level states), light having a wavelength corresponding to the energy difference is emitted.

The electroluminescent device and the method for manufacturing the same according to the present invention have, among others, the following advantages. Because Al or Ag having an excellent light reflecting characteristic is used as the lower electrode layer, the luminance of the resulting device is significantly improved because of the upward convergence effects upon light. Furthermore, because no upper insulating layer is formed on the light-emitting layer, a voltage drop due to the upper insulating layer is eliminated, thereby lowering the driving voltage, which is desirable.

When the polysilicon layer is to be grown by LPCVD at a temperature between about 560° C. and about 610° C., the resulting polysilicon layer exhibits an uneven surface profile having a plurality of hemispheric shaped bumps. Particularly in, this case, the effective surface area of the polysilicon layer significantly increases, which in turn results in a significant increase in the surface area of the light-emitting layer. This contributes to a drastic improvement of the light luminance.

It will be apparent to those skilled in the art that various modifications and variations can be made in the separating method and apparatus of the present invention without departing from the spirit or scope of the invention. Thus, it is intended that the present invention cover the modifications and variations of thus invention provided they come within the scope of the appended claims and their equivalents.

What is claimed is:

1. An electroluminescent device comprising:

a substrate having a smooth surface;

a lower electrode layer having a first surface in contact with the smooth surface of the substrate and a second surface with a plurality of convex shapes;

an insulating layer covering convex shapes over the lower electrode layer;

a light-emitting layer over the insulating layer;

an upper electrode layer formed directly on the light-emitting layer; and a passivation layer over the upper electrode layer, wherein the insulating layer, the light-emitting layer, and the upper electrode layer are formed in succession.

2. The electroluminescent device according to claim 1, wherein the lower electrode layer has a layered structure including a polysilicon layer and a metal layer.

3. The electroluminescent device according to claim 2, wherein the polysilicon layer has a plurality of convex shapes in its surface.

4. The electroluminescent device according to claim 2, wherein the metal layer includes at least one of Al and Ag.

5. The electroluminescent device according to claim 1, wherein the lower electrode layer has a layered structure including a tungsten layer and a metal layer.

6. The electroluminescent device according to claim 5, wherein the tungsten layer has a plurality of convex shapes in its surface.

7. The electroluminescent device according to claim 5, wherein the metal layer includes at least one of Al and Ag.

8. The electroluminescent device according to claim 1, wherein the insulating layer, the light-emitting layer, and the upper electrode layer have substantially the same surface profile as the lower electrode layer.

9. The electroluminescent device according to claim 1, wherein the lower electrode layer has a single layer structure of a metal layer.

10. The electroluminescent device according to claim 9, wherein the metal layer includes at least one of Al and Ag.

11. The electroluminescent device according to claim 1, wherein the insulating layer includes $BaTiO_3$.

12. The electroluminescent device according to claim 1, wherein the upper electrode layer includes indium tin oxide (ITO).

13. The electroluminescent device according to claim 1, wherein the light-emitting layer includes ZnS doped with at least one of Cu and Mn.

14. The electroluminescent device according to claim 1, wherein the uneven surface profile of the lower electrode has a plurality of convex shapes each of which is substantially hemispheric.

15. An electroluminescent device comprising:

a substrate having a smooth surface a lower electrode layer having a first surface in contact with the smooth surface of the substrate and a second surface with an uneven surface profile;

an insulating layer over the lower electrode layer, having an uneven surface profile substantially corresponding to the uneven surface profile of the lower electrode layer;

a light-emitting layer over the insulating layer, having an uneven surface profile substantially corresponding to the uneven surface profile of the insulating layer; and an upper electrode layer formed directly on the light-emitting layer, having an uneven surface profile substantially corresponding to the uneven surface profile of the light-emitting layer.

* * * * *